US010741924B1

(12) United States Patent
McGrath et al.

(10) Patent No.: US 10,741,924 B1
(45) Date of Patent: Aug. 11, 2020

(54) HYBRID NOTCH ANTENNA

(71) Applicant: Raytheon Company, Waltham, MA (US)

(72) Inventors: Daniel T. McGrath, McKinney, TX (US); Michael Streitwieser, McKinney, TN (US); Brian W. Johansen, McKinney, TX (US)

(73) Assignee: Raytheon Company, Waltham, MA (US)

( * ) Notice: Subject to any disclaimer, the term of this patent is extended or adjusted under 35 U.S.C. 154(b) by 6 days.

(21) Appl. No.: 16/284,158

(22) Filed: Feb. 25, 2019

(51) Int. Cl.
*H01Q 13/10* (2006.01)
*H01Q 13/08* (2006.01)
*H01Q 5/30* (2015.01)
*H01Q 21/06* (2006.01)

(52) U.S. Cl.
CPC ..... *H01Q 13/085* (2013.01); *H01Q 5/30* (2015.01); *H01Q 21/064* (2013.01); *H01Q 13/10* (2013.01)

(58) Field of Classification Search
CPC ..... H01Q 13/10
USPC ..... 343/767, 770
See application file for complete search history.

(56) References Cited

U.S. PATENT DOCUMENTS 5,742,257 A * 4/1998 Hadden ..... H01Q 13/085 343/767
5,973,653 A 10/1999 Kragalott et al.
6,839,036 B1 * 1/2005 Apostolos ..... H01Q 1/36 343/767
6,850,203 B1 2/2005 Schuneman et al.
6,995,728 B2 2/2006 Rodriguez
7,088,300 B2 8/2006 Fisher
7,652,631 B2 1/2010 McGrath
8,648,759 B2 * 2/2014 Wang ..... H01Q 1/286 343/700 MS
9,270,027 B2 * 2/2016 Waschenko ..... H01Q 13/10
9,614,290 B1 * 4/2017 Remski ..... H01Q 21/064
2005/0012672 A1 * 1/2005 Fisher ..... H01Q 13/085 343/767
2005/0088353 A1 4/2005 Irion, II
2008/0211726 A1 9/2008 Elsallal et al.
2015/0002354 A1 1/2015 Knowles
2018/0366830 A1 12/2018 Cheung et al.

OTHER PUBLICATIONS

U.S. Appl. No. 15/896,668 (RTN Ref. No. 17-10063-US-NP), filed Feb. 14, 2018, McGrath.
International Search Report and Written Opinion of the ISA dated Dec. 3, 2019 for International Application No. PCT/US2019/053351; 14 Pages.

* cited by examiner

*Primary Examiner* — Thuy Vinh Tran
(74) *Attorney, Agent, or Firm* — Daly, Crowley, Mofford & Durkee LLP

(57) ABSTRACT

Described is a hybrid notch antenna comprising a flared notch antenna structure and a transverse electromagnetic (TEM) horn structure having walls disposed through or attached to the notch antenna structure member such that the TEM horn is integrated with the notch antenna to form a hybrid TEM/notch antenna.

10 Claims, 5 Drawing Sheets

HYBRID NOTCH ANTENNA

BACKGROUND

Radiation of electromagnetic signals having high-power and arbitrary polarizations over ultra-wide frequency bandwidths from size-constrained installations are required for many applications. To meet such requirements, multiple antennas covering different frequency bands and polarizations are typically used. It would, therefore, be desirable to provide a single antenna which can meet the high-power, arbitrary polarization, and ultra-wide frequency bandwidth with a compact structure.

SUMMARY

This Summary is provided to introduce a selection of concepts in simplified form that are further described below in the Detailed Description. This Summary is not intended to identify key or essential features or combinations of the claimed subject matter, nor is it intended to be used to limit the scope of the claimed subject matter.

One aspect of the present disclosure relates to a hybrid notch antenna comprising a flared notch element provided from a member disposed in a first plane and having a notch therein. At least two conductive walls are disposed through the member on either side of the notch and each of the at least two conductive walls aligned along a second plane which is perpendicular to the first plane.

In embodiments, at least two conductive walls form a transverse electromagnetic (TEM) horn structure integrated with the flared notch element. The TEM horn structure can have a shape selected to affect the impedance of the hybrid notch antenna to extend its bandwidth beyond that of the flared notch alone.

In further embodiments, a dielectric insulator can be disposed in the notch of said flared notch element. The dielectric insulator can encapsulate the notch of said flared notch element. The flared notch element and the integrated TEM horn structure can form a first transmit antenna element.

In embodiments, the hybrid notch antenna can further comprise additional transmit antenna elements, wherein each additional transmit antenna element is formed from an additional flared notch element and an additional TEM horn structure. For example, in embodiments, the hybrid notch antenna can further comprise second, third, and fourth transmit antenna elements, wherein each of the second, third, and fourth transmit antenna elements are formed from second, third, and fourth flared notch elements and TEM horn structures, respectively. The first, second, third, and fourth transmit antenna elements can further be oriented to form a four-antenna rosette. In additional embodiments, each of the plurality of hybrid TEM/notch antenna elements can be configured to generate various polarizations in response to alternating amplitudes and phases.

In embodiments, each of the hybrid TEM/notch antenna elements can comprise a flared notch element provided from a member disposed in a first plane and having a notch therein. A transverse electromagnetic (TEM) horn structure having walls can be disposed through said member such that the TEM horn is integrated with the flared notch element. The TEM horn structure can have a shape selected to affect an impedance of the hybrid notch antenna to extend its bandwidth beyond that of the flared notch alone.

In further embodiments, a dielectric insulator can be disposed in the notch of said flared notch element. The dielectric can partially or completely encapsulate the notch of said flared notch element.

Additionally, each of the plurality of hybrid TEM/notch antenna elements can form a transmit antenna element. Further, each of the plurality of hybrid TEM/notch antenna elements may be configured to generate vertical (V), horizontal (H), or circular polarizations in response to alternating phases.

In yet another aspect, a hybrid notch antenna comprises a member which forms a notch antenna. A transverse electromagnetic (TEM) horn structure having walls is disposed through said member such that the TEM horn is integrated with the notch antenna.

DESCRIPTION OF THE PRIOR ART

Various methods have been reported to extend the operating bandwidth of flared notch antennas. For example, Schuneman et al. (U.S. Pat. No. 6,850,203 B1) and Fisher (U.S. Pat. No. 7,088,300 B2) use shaping of the notch profile. McGrath (U.S. Pat. No. 7,652,631 B2) adds peripheral slots with capacitive loading. These efforts highlight the need to extend bandwidth without increasing the notch depth.

Various arrangements of single-arm feeds for flared notch and TEM horn antennas are shown in the literature. Examples are a strip transmission line on the center layer of a three-printed-layer notch reported by multiple authors, including Schuneman et al. (U.S. Pat. No. 6,850,203 B1). Alternatively, a coaxial waveguide may be trimmed flush with one notch arm as in McGrath (U.S. Pat. No. 7,652,631 B2) or TEM plate as in Kragalott & Pala (U.S. Pat. No. 5,973,653), with the center conductor extending across the gap and joining the second arm or plate. Recently McGrath et al. (U.S. application Ser. No. 15/896,668, filed on Feb. 14, 2018) have shown a method for using a pair of feeds entering from opposite sides to exceed the power-handling limits of a single feed. Any of these feed arrangements may be incorporated in the present invention.

Rodriguez (U.S. Pat. No. 6,995,728) used a flared notch with coaxial input to drive a TEM horn antenna, thereby improving the impedance match between a coaxial waveguide and the TEM horn. The present invention is distinct in that it uses a TEM-like structure to alter a flared notch antenna's input impedance in such a way as to allow it to operate over significantly lower frequencies than the simple notch. The result is a structure that has markedly different shape and dimensions than Rodriguez.

BRIEF DESCRIPTION OF THE DRAWINGS

The foregoing and other objects, features and advantages will be apparent from the following more particular description of the embodiments, as illustrated in the accompanying drawings in which like reference characters refer to the same parts throughout the different views. The drawings are not necessarily to scale, emphasis instead being placed upon illustrating the principles of the embodiments.

DETAILED DESCRIPTION

Figure 1:
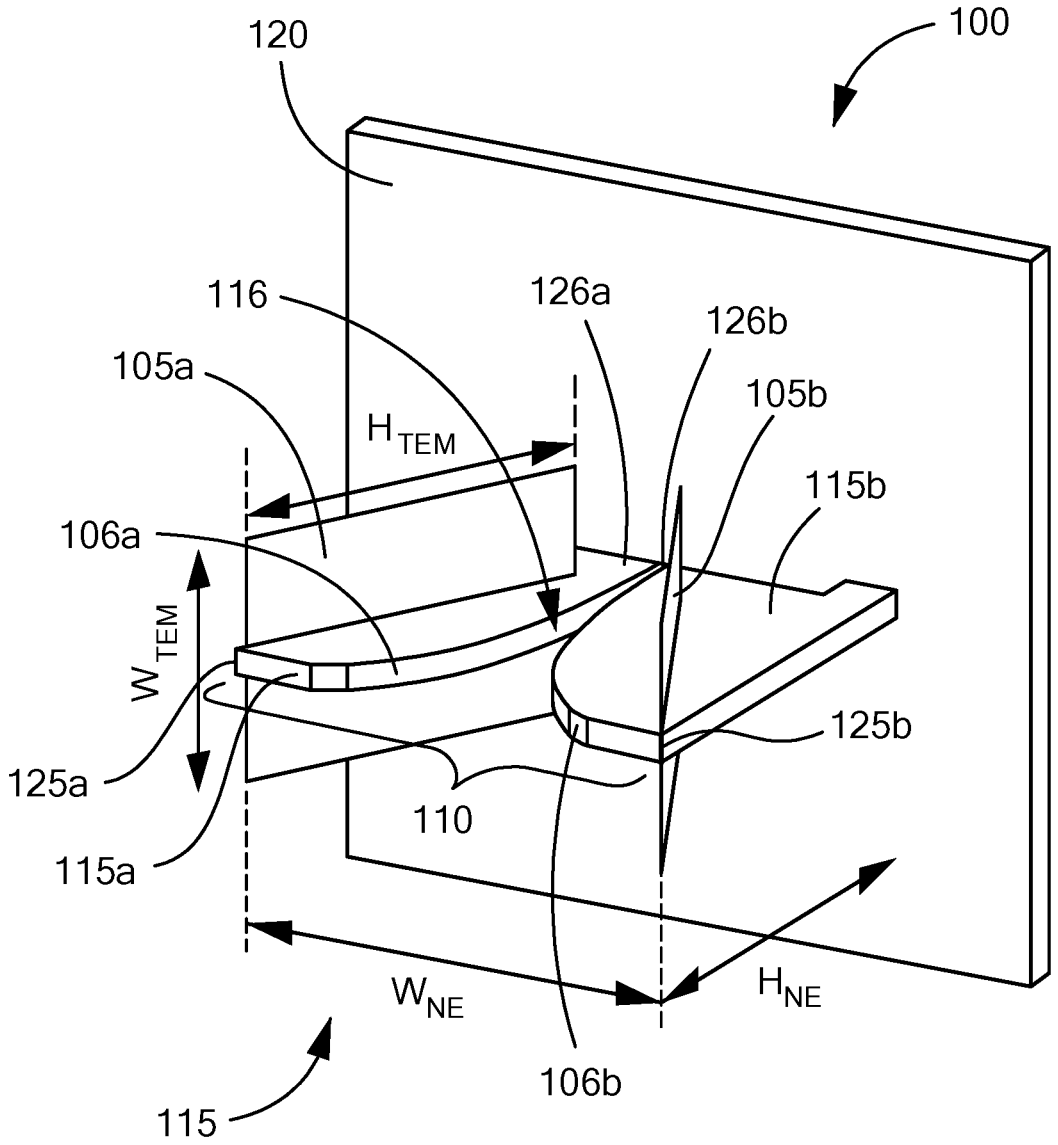
FIG. 1 is an isometric view of hybrid transverse electromagnetic (TEM)/notch antenna according to an example embodiment.

Referring to FIG. 1, a hybrid transverse electromagnetic (TEM)/notch antenna 100 comprises a flared notch element 110 disposed over a ground plate 120 and in a first plane perpendicular to the ground plane 120. The flared notch element 110 comprises first and second members 115*a-b* having first-member and second-member tapered surfaces 106*a-b*. The first member 115*a* is positioned across from the second member 115*b* such that the first-member tapered surface 106*a* faces the second-member tapered surface 106*b*. The first and second members 115*a-b* (collectively, a notch member 115) are positioned to define a notch 116.

In embodiments, a first conductive wall 105*a* and a second conductive wall 105*b* are disposed through the first and second members 115*a-b*, respectively, and are aligned along a second plane perpendicular to the first plane. The pair of first and second conductive walls 105*a-b* can be considered a transverse electromagnetic (TEM) horn structure integrated with the flared notch element 110. The TEM horn structure 105*a-b* is provided having a shape selected to affect the impedance of the hybrid notch antenna 100 to increase the bandwidth of the hybrid notch antenna 100.

In embodiments, the notch member 115 can have a height '$H_{NE}$' extending from the ground plane 120. The notch member 115 can have a width '$W_{NE}$'. These dimensions can be made as large as possible (subject to installation and packaging constraints) to obtain the widest possible bandwidth.

In additional embodiments, the TEM horn structures 105*a-b* can have a height '$H_{TEM}$'. Additionally, the TEM horn structures 105*a-b* are spaced away from the ground plane 120 (i.e., such that the TEM horn structures 105*a-b* are not in physical contact with the ground plane 120). Further, the TEM horn structures 105*a-b* can have a width '$W_{TEM}$'. In some embodiments, the TEM horn structures 105*a-b* can be slanted from first and second top corners 126*a-b* toward first and second bottom corners 126*a-b* of the notch member 115. The TEM horn size, interior angle, and position relative to the ground plane are adjusted using numerical simulations to optimize performance in terms of VSWR vs. frequency and/or radiation pattern shape.

In embodiments, the ground plane 120, the notch plates 115*a* and 115*b*, and the TEM plates 105*a* and 105*b* may be any material such as Copper or Aluminum, that is a good conductor at the frequencies of operation.

The hybrid transverse electromagnetic (TEM) horn/notch antenna 100 can be configured, via the flared notch element 110 and the TEM horn structures 105*a-b*, to provide greater bandwidth than traditional notch antennas. The TEM horn structures 105*a-b* form a tuning element that increases the bandwidth of the notch 110, resulting in a reduced VSWR at low frequencies, thus extending the low frequency cutoff (the lowest frequency at which VSWR is within acceptable limits).

Figure 2A:
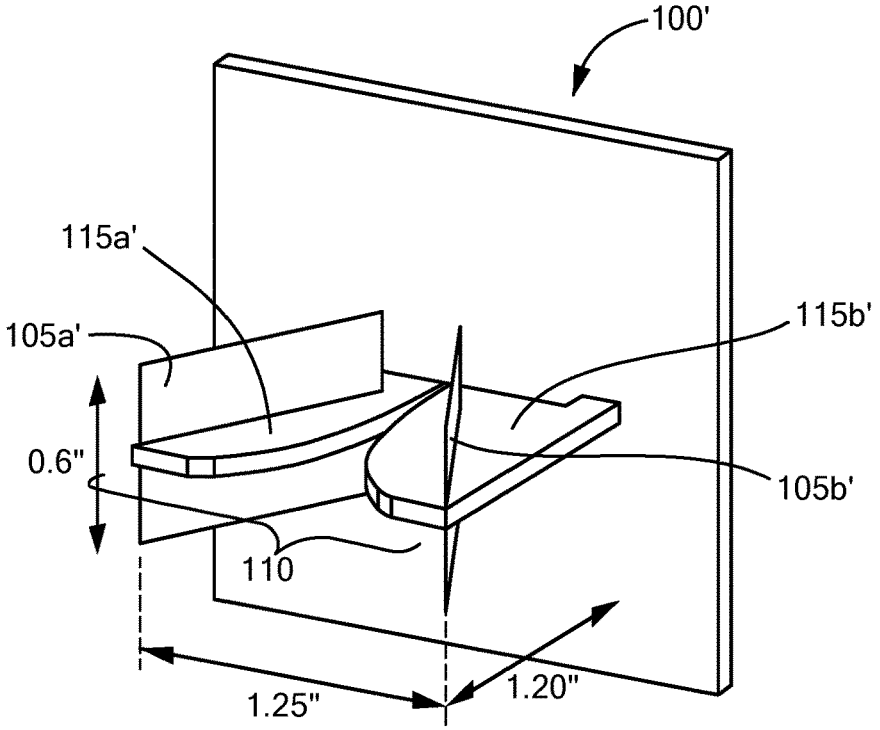
FIG. 2A is another isometric view of hybrid transverse electromagnetic (TEM)/notch antenna illustrating sample dimensions according to an example design and embodiment.
Figure 2B:
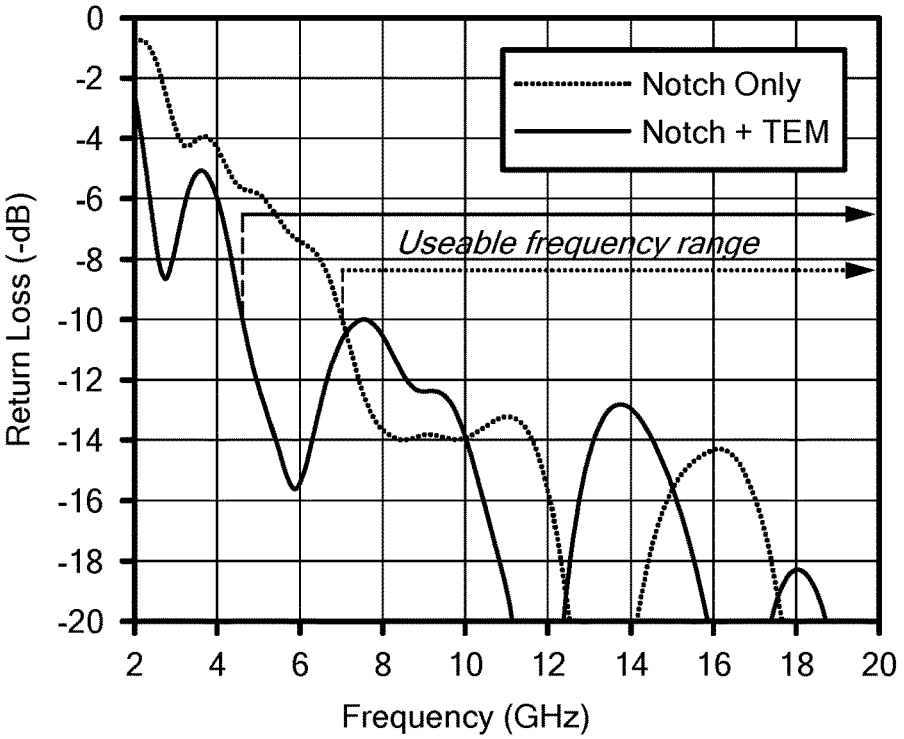
FIG. 2B illustrates sample performance metric for the example TEM/notch antenna of FIG. 2A according to example embodiments.

For example, referring to FIG. 2A, illustrating dimensions of the notch member 115' and the TEM horn structures 105*a-b*', the TEM/notch antenna 100' can experience a return loss vs. frequency from a 50 Ohm source as shown in FIG. 2B. Since 10 dB return loss is a generally-accepted rule-of-thumb for being able to use an antenna for high-power radiation, it is evident that without the TEM plates 105*a-b*', the notch 110 is only useful for frequencies above 7 GHz, whereas with the TEM plates added, it is useful for frequencies of 4.5 GHz and above. The combined structure reduced the low-end cutoff by about ⅓ without increasing the overall antenna size as compared to the notch alone. Therefore, a simple notch antenna would need to be approximately 4/3 times as large in all linear dimensions to achieve the same performance. It is anticipated that the methods proposed by Schuneman (U.S. Pat. No. 6,850,203 B1), Fisher (U.S. Pat. No. 7,088,300 B2), McGrath (U.S. Pat. No. 7,652,631 B2) and others may be combined with this invention to obtain further performance improvement.

Figure 3:
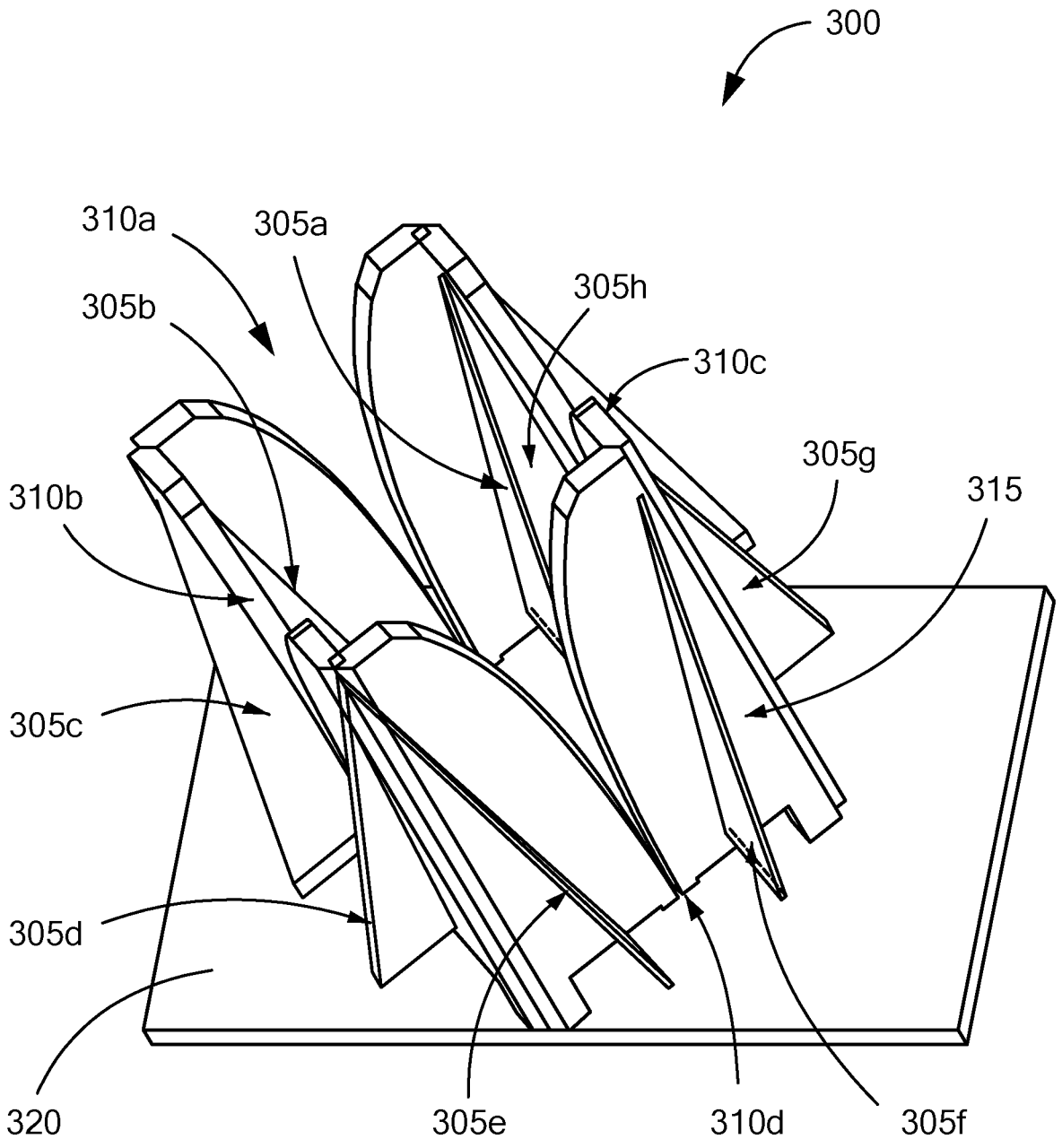
FIG. 3 is an isometric view of a plurality or array of hybrid TEM/notch antennas disposed symmetrically about an axis according to embodiments described herein.

Referring to FIG. 3, a hybrid transverse electromagnetic (TEM)/notch antenna array 300 comprises a rosette of hybrid TEM/notch antenna elements 310*a-d* ("hybrid antenna elements," collectively 310) disposed over a ground plane 320. Although four hybrid TEM/notch antenna elements are shown, a skilled artisan understands that an antenna array (e.g., the array 300) can comprise any number of hybrid antenna elements 310. Each of the hybrid antenna elements 310 can be substantially similar to the hybrid transverse electromagnetic (TEM)/notch antenna 100 of FIG. 1. For example, each of the hybrid antenna elements 310*a-b* comprises a notch member 315 (e.g., the notch member 115 of FIG. 1) comprising a notch 316. The notch member 315 is disposed over the ground plane 320 and in a first plane perpendicular to the ground plane 320. Additionally, TEM horn structures 305 can be integrated with the notch members 315. As shown here, the TEM horns are plates 305*a* and 305*b* associated with notch 310*a*; plates 305*c* and 305*d* associated with notch 310*b*; plates 305*e* and 305*f* associated with notch 310*c*; and plates 305*g* and 305*h* associated with notch 310*d*. Plates may be trimmed along their intersections, for example plates 305*a* and 305*h*.

Figure 4:
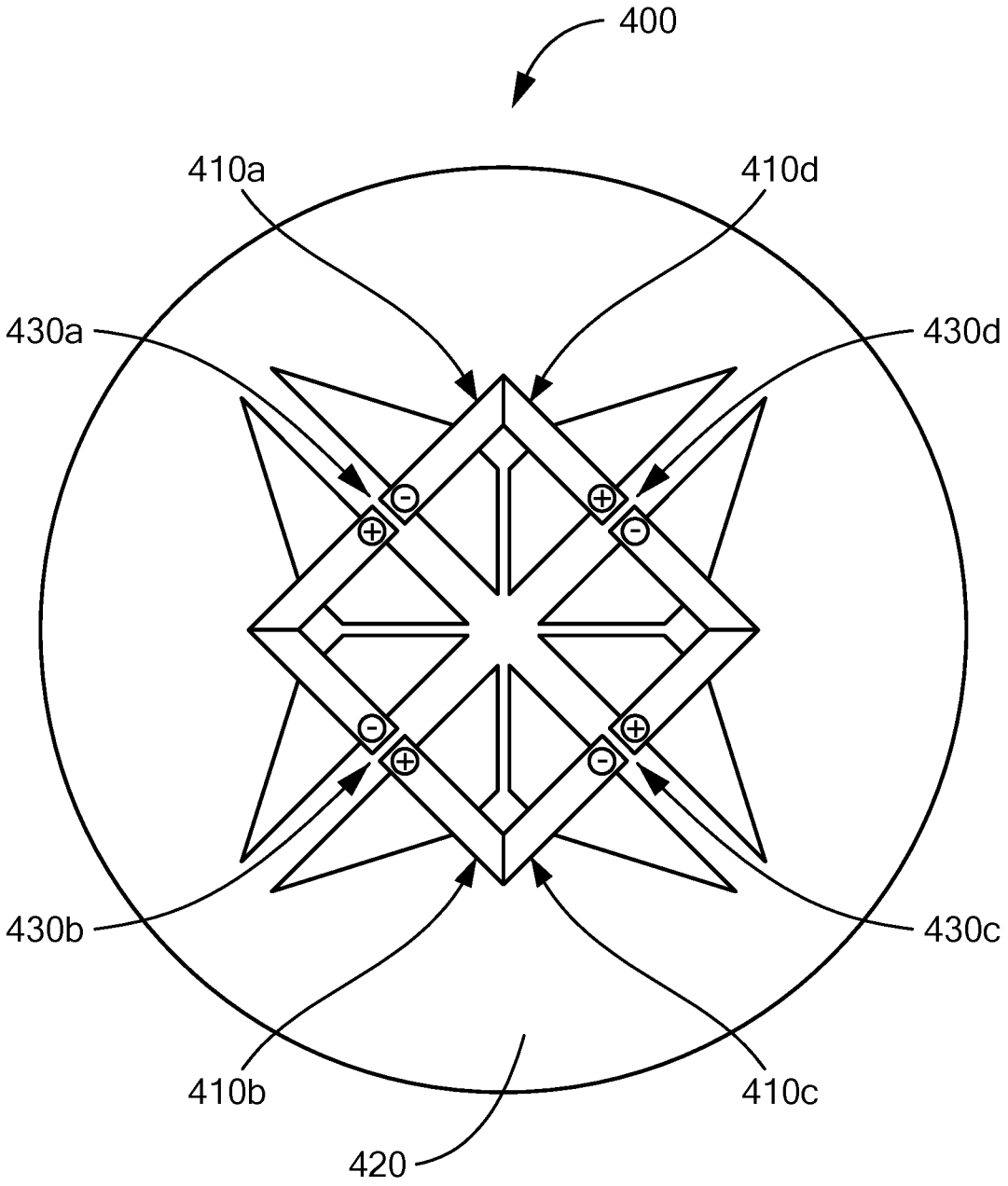
FIG. 4 is a front view of the array of FIG. 3 according to embodiments described herein.

Referring to FIG. 4, hybrid antenna elements 410*a-d* are shown oriented diagonally with respect to an observer. A combination of the four elements 410*a-d* can produce arbitrary antenna polarizations. For radiation in or near the direction perpendicular to the ground plane (e.g., ground plane 120 of FIG. 1), a first antenna pair comprising elements 410*a* & 410*d*, with feeds at locations 430*a* & 430*d*, produces electric fields that are oriented orthogonal to a second antenna pair comprising elements 410*b* & 410*c*, with feeds at locations 430*b* & 430*c*. Pluses and minuses indicate the orientation of the feed connections. By controlling the relative phases of each pair, arbitrary polarizations may be produced. For example, if feeds 430*a* through 430*d* are driven with relative phases of 0°, 0°, 180°, and 180°, the resulting radiation will be vertically polarized. Relative phases of 0°, 180°, 180°, and 0° will produce horizontal polarization. Relative phases of 0°, 90°, 180°, and 270° or 0°, −90°, −180°, and −270° will produce circular polarization. Other combinations of phases with unequal amplitudes may produce any linear or elliptical polarization.

Figure 5:
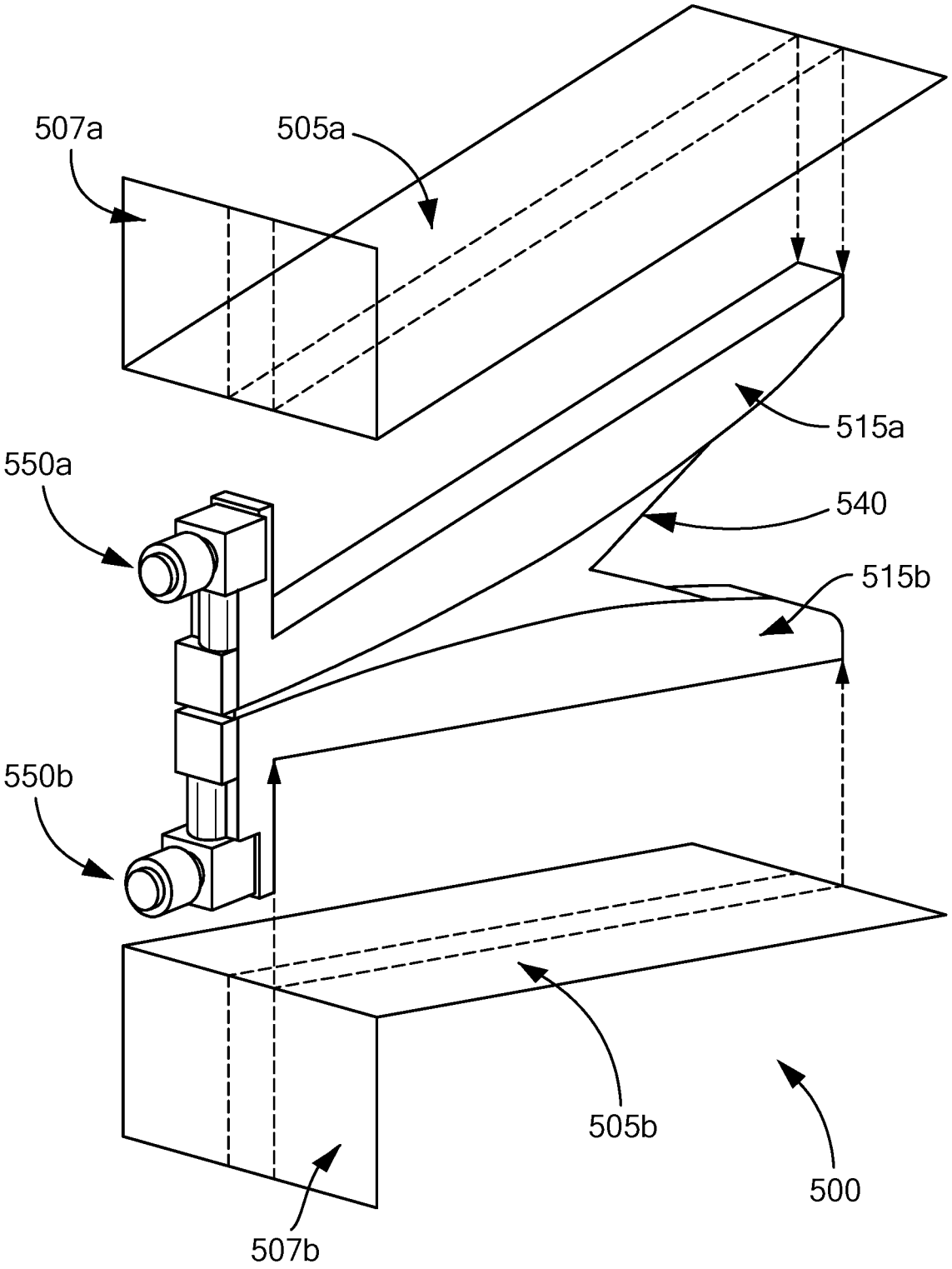
FIG. 5. is an isometric view of a single hybrid antenna in which the outer edges of the notch are shaped to accept TEM plates, and which uses dual coaxial feeds and a dielectric insert according to an example embodiment.

Referring to FIG. 5, a single flared notch 500 comprises notch arms 515*a-b* having interior surfaces shaped according to a typical exponential shape. Outside surfaces of the notch arms 515*a-b* are trimmed to accept metal plates 505*a* and 505*b* that form a TEM horn portion. The plates 505*a-b* may be attached to the notch arms 515*a-b* by any convenient method, for example, soldering, welding, bonding, or with fasteners such as screws or rivets. The plates 505*a-b* may be formed as bent pieces of sheet metal, with the additional portions 507*a* and 507*b* included for mechanical rigidity. An interior of the notch 500 may be partially filled with a dielectric insert 540. The dielectric insert 540 can: (1) ensure precise spacing between the arms 515*a* and 515*b*; and (2) allow the antenna to radiate high power. The dielectric insert 540 can comprise an insulator material that has a high dielectric breakdown strength and low radio frequency loss, for example thermoset resins. An additional feature is the use of twin feeds 550*a* and 550*b* configured to supply equal signals with opposite phase, to increase a supplied radio frequency power above the limit of a single coaxial input, as described in McGrath et al. (U.S. application Ser. No. 15/896,668, filed on Feb. 14, 2018).

One skilled in the art will realize the invention may be embodied in other specific forms without departing from the spirit or essential characteristics thereof. The foregoing embodiments are therefore to be considered in all respects illustrative rather than limiting of the invention described herein. Scope of the invention is thus indicated by the appended claims, rather than by the foregoing description, and all changes that come within the meaning and range of equivalency of the claims are therefore intended to be embraced therein.

What is claimed is:

1. A hybrid notch antenna comprising:

a flared notch element provided from a member disposed in a first plane and having a notch therein;

at least two conductive walls disposed through, or attached to, the member on either side of the notch.

2. The antenna of claim 1, wherein the at least two conductive walls form a transverse electromagnetic (TEM) horn structure integrated with the flared notch element.

3. The antenna of claim 2, wherein the TEM horn structure is provided having a shape and position selected to affect an impedance of the hybrid notch antenna to extend a bandwidth of the hybrid notch antenna.

4. The antenna of claim 2 wherein a dielectric insulator is disposed in the notch of said flared notch element.

5. The antenna of claim 4 wherein said dielectric insulator encapsulates the notch of said flared notch element.

6. The antenna of claim 2, wherein the flared notch element and the integrated TEM horn structure form a first antenna element.

7. The antenna of claim 6 further comprising additional transmit antenna elements, wherein each additional antenna element is formed from an additional flared notch element and an additional TEM horn structure.

8. The antenna of claim 6 further comprising second, third, and fourth antenna elements, wherein each of the second, third, and fourth antenna elements is formed from second, third, and fourth flared notch elements and TEM horn structures, respectively.

9. The antenna of claim 8, wherein the first, second, third, and fourth transmit antenna elements are oriented to form a four-antenna rosette.

10. The system of claim 9, wherein each of the plurality of hybrid TEM/notch antenna elements is configured to generate various polarizations in response to alternating amplitudes and phases.

* * * * *